United States Patent [19]

Greene

[11] 4,096,554

[45] Jun. 20, 1978

[54] ROTATIONAL COLLAR ALIGNMENT DEVICE

[75] Inventor: Albert Alfonso Greene, Cleveland, Ohio

[73] Assignee: Conserve-A-Watt Corporation, North Canton, Ohio

[21] Appl. No.: 734,019

[22] Filed: Oct. 19, 1976

[51] Int. Cl.[2] ..... F21S 3/00; F21V 19/02

[52] U.S. Cl. ..... 362/220; 362/404

[58] Field of Search ..... 240/51.11 R, 73 R, 78 R, 240/78 B, 78 HA

[56] References Cited

U.S. PATENT DOCUMENTS 3,908,120 9/1975 Greene ..... 240/78 R X

*Primary Examiner*—Richard L. Moses

*Attorney, Agent, or Firm*—Fay & Sharpe

[57] ABSTRACT

A self-contained fluorescent lamp fixture for installation in association with both flush and recess mounted electrical outlet boxes which permits selective adjustment of the fluorescent lamp fixture through a substantial arc and which readily facilitates retention of the fixture in the adjusted position. The fixture includes a body cover which is adapted to receive a conventional fluorescent tube as well as the other operative components. This cover includes a pair of opposed, generally centrally located arcuate slots and is mounted between upper and lower fixture collars by a pair of threaded fasteners. The fasteners pass between the collars through the arcuate slots whereby the cover may be selectively rotated in a plane normal to the axis of the fixture. A flat outlet box cover plate is mounted to the uppermost end of the upper collar by these same threaded members. The cover plate, in turn, includes means for conveniently mounting it to an outlet box for supporting the entire fixture. A generally flat, compressible member is received between one of the collars and the fixture body cover for placing a continuous biasing force against the cover when the collars are brought into a close spaced relationship with each other. This arrangement facilitates alignment of the fixture once it has been installed in operative association with an outlet box and the frictional force exerted by the compressible member acts to retain the fixture in the aligned position. A thin cover shield may be conveniently interposed between the cover plate and upper collar to aesthetically cover the outlet box opening in a wall or ceiling.

16 Claims, 8 Drawing Figures

FIG. 2
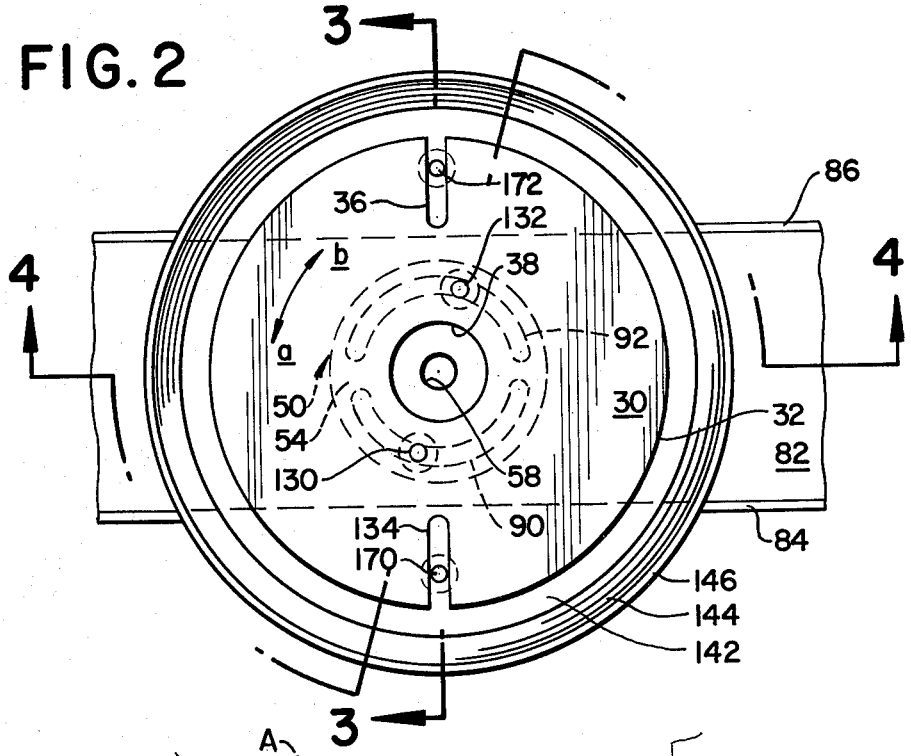
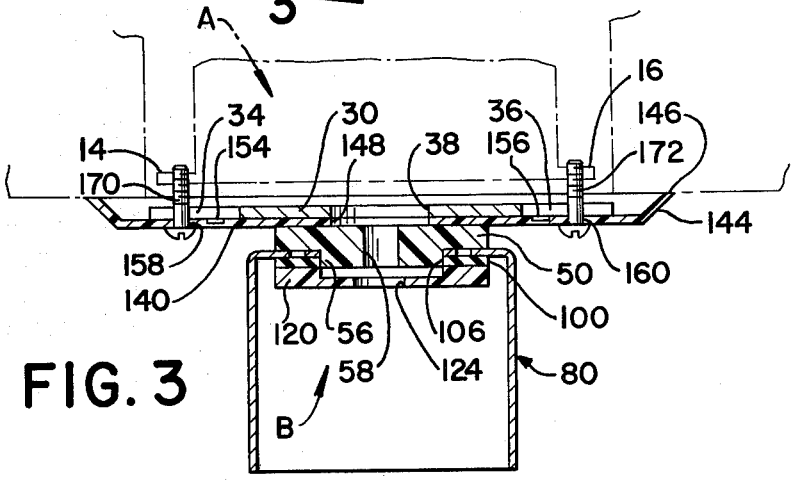
FIG. 3
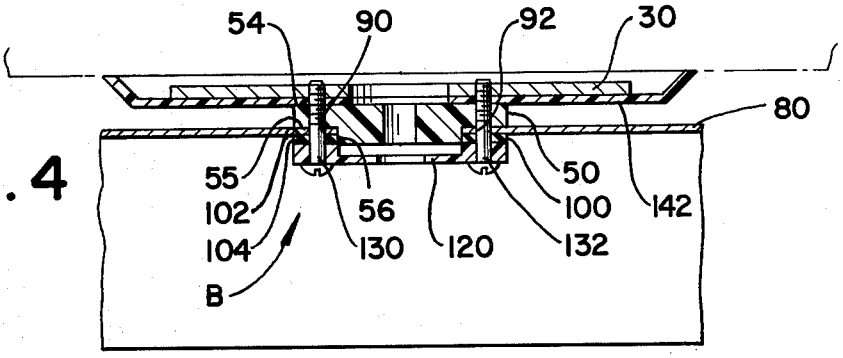
FIG. 4

FIG. 5
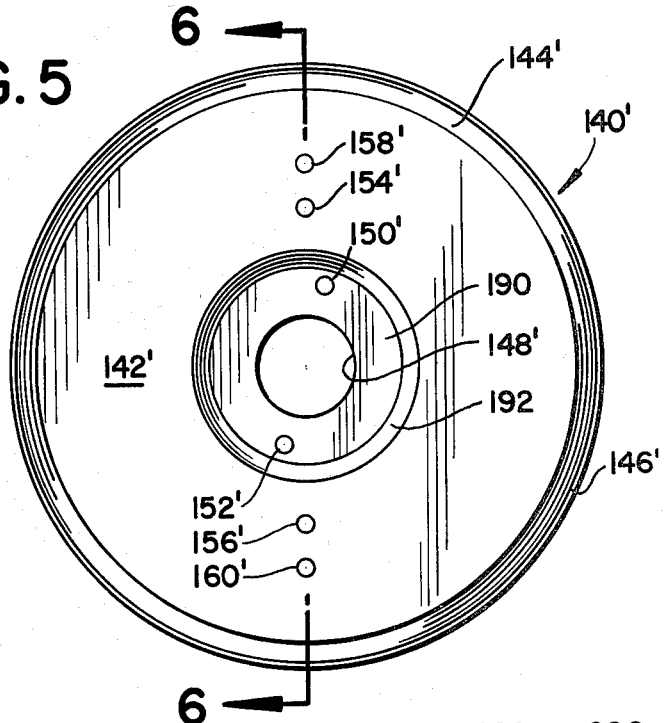
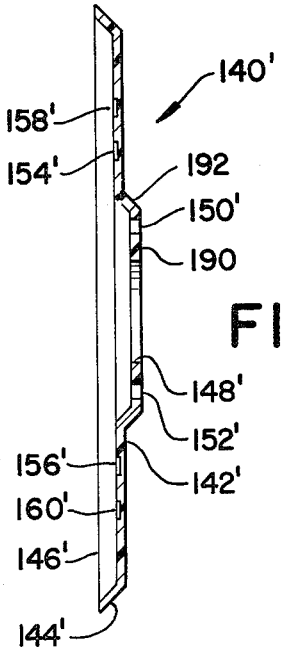
FIG. 6
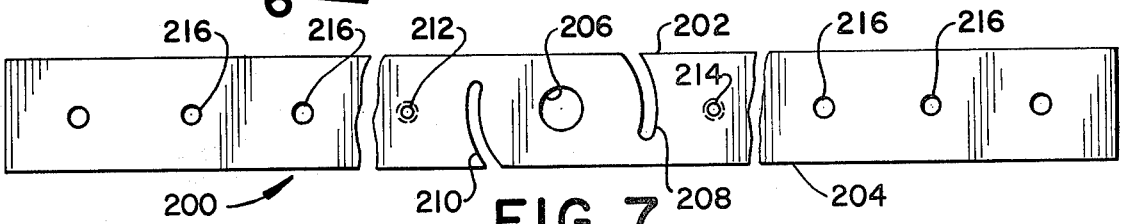
FIG. 7
FIG. 8
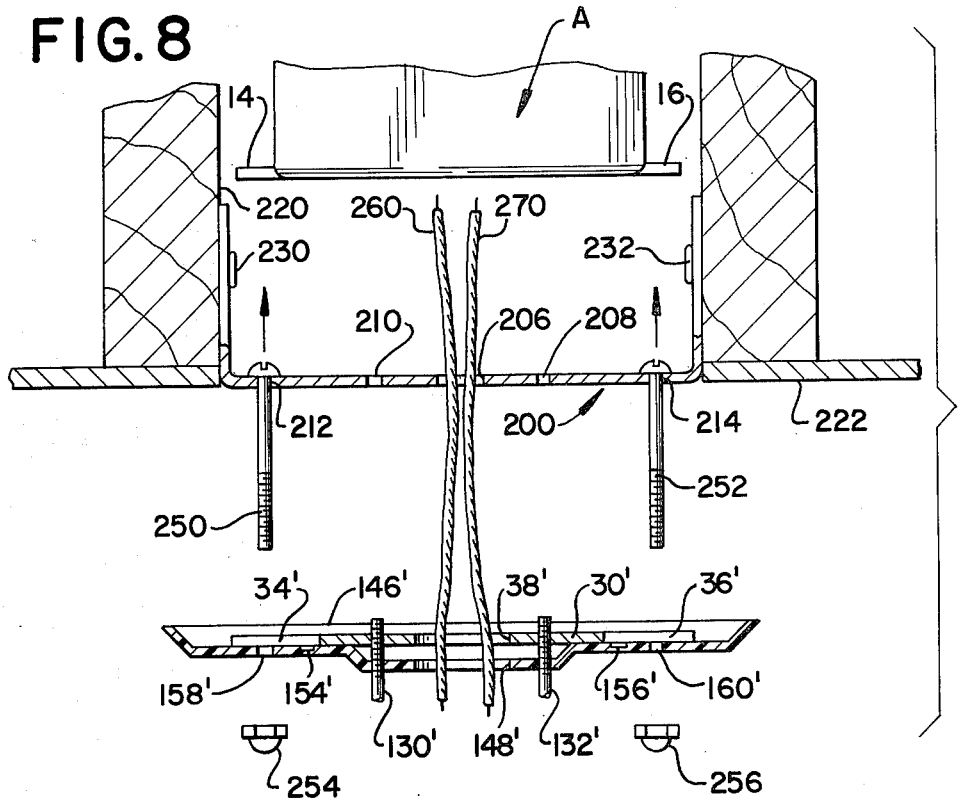

ROTATIONAL COLLAR ALIGNMENT DEVICE

BACKGROUND OF THE INVENTION

This invention pertains to the art of lamp fixtures and more particularly to fluorescent type lamp fixtures.

The invention is particularly applicable to selfcontained fluorescent fixtures and will be described with particular reference thereto; however, it will be appreciated by those skilled in the art that the invention has broader applications and may also be employed in other environments.

The concepts of this application represent an improvement on the concepts disclosed and claimed in the commonly assigned U.S. Pat. No. 3,908,120, issued Sept. 23, 1975. Non essential subject matter therefrom is incorporated hereinto by reference.

While the arrangement of the aforementioned 3,908,120 patent has found some substantial commercial success in practical application for utilizing incandescent type lamp sockets to accommodate fluorescent type lamp fixtures, it has now been found that it is sometimes particularly desirable to mount a self-contained fluorescent lamp fixture for utilization with a conventional electrical outlet box. The advantages obtained in converting from incandescent to fluorescent lighting are fully explored in the 3,908,120 patent and are incorporated hereinto by reference.

In utilizing the structure of this earlier patent, the mounting thereof to a conventional incandescent lamp socket caused the fluorescent lamp fixture to protrude outwardly somewhat from a wall or ceiling due to the outward protrusion of the socket itself. Where the available wall space and/or ceiling height is limited and/or a problem, it has been desired to reduce the amount of outward protrusion when the fixture is operationally mounted. Moreover, it has been found that a mounting arrangement which permits the fluorescent lamp fixture to be mounted substantially flush against a wall or ceiling has also been desired for aesthetic reasons.

It has, therefore, been desired to develop a selfcontained fluorescent lamp fixture which would meet the above described criteria in order to capitalize on the benefits obtained from using fluorescent type lighting and still overcome the structural deficiencies encountered with prior self-contained fluorescent lamp fixtures. Such deficiencies are fully discussed in the 3,908,120 patent and such discussion is deemed to be incorporated hereinto by reference.

Accordingly, the present invention contemplates a new and improved self-contained fluorescent lamp fixture which meets the aforementioned criteria while overcoming problems associated with prior self-contained fluorescent fixtures and provides a new and improved fixture which is simple in design, economical in construction, provides readily adjustable means for the fluorescent tube through a substantial arc, includes convenient locking means for retaining the fluorescent tube in a desired aligned position and which is particularly adapted for use with both flush and recessed mounted electrical boxes.

BRIEF DESCRIPTION OF THE PRESENT INVENTION

In accordance with the present invention, the fluorescent fixture includes means for mounting the fixture in operative association with a source of electrical energy.

A fixture body is associated with the mounting means and which is adapted to receive and support a fluorescent light tube along with the other conventional operative components. The fixture body cover includes generally centrally located arcuate slots for receiving mechanical fasteners which pass therethrough and into the mounting means for locating the cover thereon. When in position, the fixture body cover is selectively movable about the slots in a plane generally normal to the plane of the body cover. Force means are also provided adjacent the body cover for continuously exerting a biasing force against the cover to retain it in a desired aligned position while still allowing for selected forced rotational movement thereof about the arcuate slots.

In accordance with another aspect of the present invention, the fixture further includes interconnected upper and lower collars. The upper collar and mounting means are operably associated with the fixture body cover and force means being received between the two collars.

In accordance with still another aspect of the present invention, the force means comprises a generally flat, compressible annular member and the mechanical fasteners comprise threaded fasteners. The fasteners provide means for bringing the upper and lower collars into a close spaced relationship with the fixture body cover and compressible member disposed therebetween. The compressible member is thus placed in a compressed state to exert a continuous biasing force against the body cover whereby the body cover will be retained in any desired pre-set position.

In accordance with still a further aspect of the present invention, the mounting means comprises a mounting plate adapted to be directly mounted to a conventional flush mounted electrical outlet box.

In accordance with still another aspect of the present invention, the self-contained fluorescent fixture includes a cover shield disposed intermediate the upper collar and mounting plate in order to hide the outlet box area and provide an overall aesthetically pleasing appearance therefor.

The principal object of the present invention is the provision of an improved self-contained fluorescent lamp fixture.

Another object of the present invention is the provision of an improved self-contained fluorescent type lamp fixture which includes convenient means to facilitate alignment of the fluorescent tube following fixture installation.

Still another object of the present invention is the provision of an improved self-contained fluorescent lamp fixture which includes means for automatically retaining alignment of the fluorescent tube and tube supporting structure once the same has been aligned as desired.

A still further object of the present invention is the provision of an improved self-contained fluorescent lamp fixture which may be easily installed on both flush and recessed electrical outlet boxes.

Another object of the present invention is the provision of an improved self-contained fluorescent lamp fixture which eliminates the conventional requirement of disassembly and re-assembly of such fixture prior and subsequent to directly mounting the fixture upon both conventional and recessed electrical outlet boxes.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein:

FIG. 2 is a plan view of the assembled light fixture of FIG. 1;

FIG. 3 is a cross-sectional view taken along lines 3—3 of FIG. 2 and including cut away areas for ease of illustration;

FIG. 4 is a cross-sectional view taken along lines 4—4 of FIG. 2;

FIG. 5 is a plan view of a cover shield used with the fixture structure of the subject invention;

FIG. 6 is a cross-sectional view taken along lines 6—6 of FIG. 5;

FIG. 7 is a plan view of a mounting strip employed when mounting the fixture structure of the subject invention to a recessed outlet box; and, FIG. 8 is a side view in partial cross-section showing a fixture as it would be mounted to a recessed outlet box using the strip of FIG. 7.

DESCRIPTION OF THE PREFERRED EMBODIMENT

Figure 1:
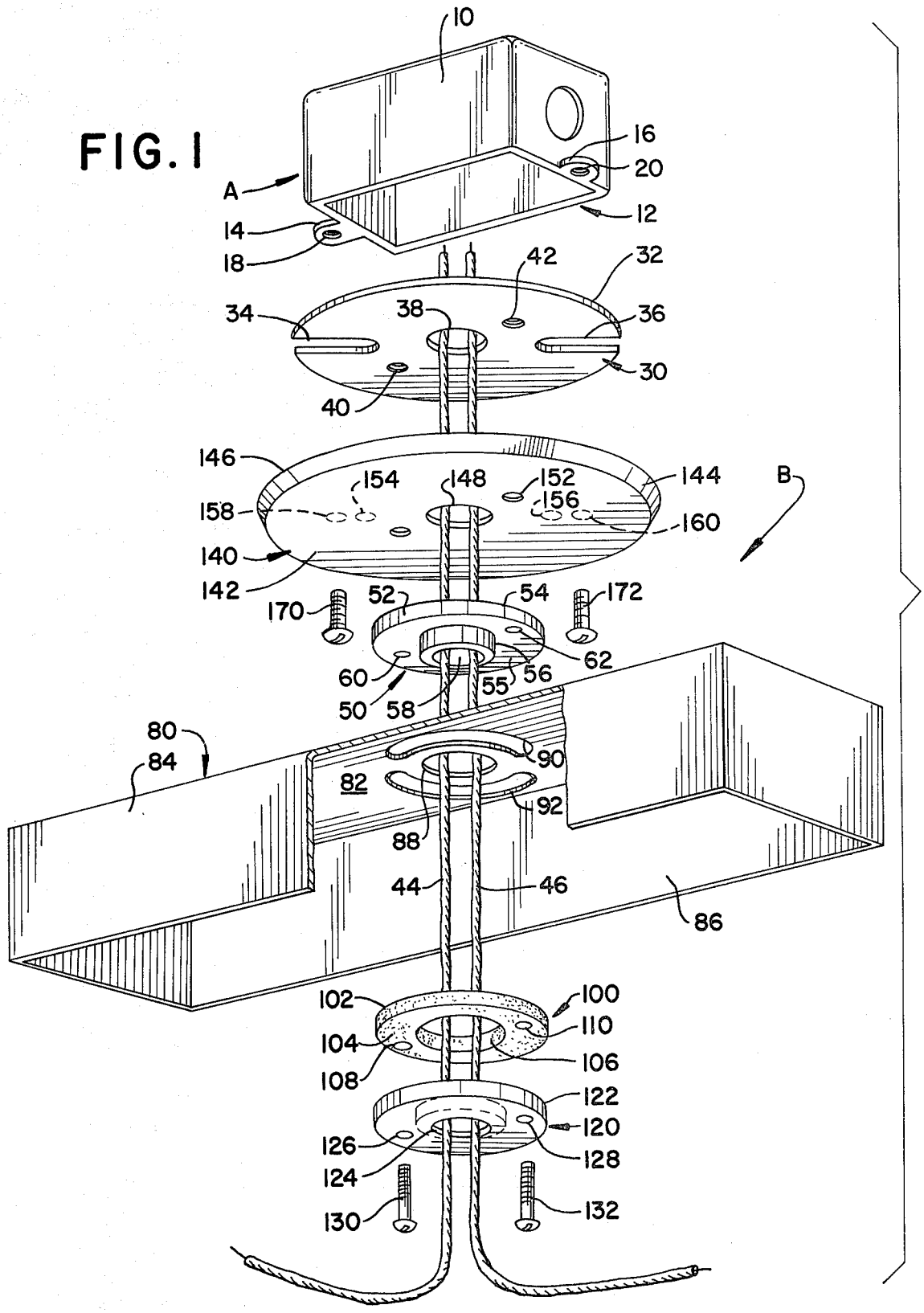
FIG. 1 is an exploded perspective view of a fluorescent light fixture which includes the concepts of the subject invention.

Referring now to the drawings wherein the showings are for purposes of illustrating the preferred embodiment of the invention only and not for purposes of limiting the same, the FIGURES show a conventional electrical outlet box generally designated A and a self-contained fluorescent fixture generally designated B which comprises the primary focus of the subject invention.

The conventional electrical outlet box generally comprises a box-like configuration 10 having an open end 12 facing outwardly from a wall or ceiling area. Typically, these outlet boxes are mounted in ceilings or wall open ends 12 are disposed generally flush with the plane of the ceilings and walls. The boxes themselves house electrical wiring terminals for lights, plugs, switches and the like in building structures. Extending outwardly from opposed side walls of the box are tabs or ears 14,16 which include threaded fastener receiving holes 18,20. Of course, the invention is equally applicable to use with outlet boxes having tabs or ears which extend inwardly toward each other from opposed box side walls. These holes are normally used to receive fasteners which secure cover plates, plugs, switches, light fixtures and the like as is known. Indeed, the incandescent light fixture shown in the commonly assigned 3,908,120 partent would itself be affixed to an outlet box such as the one shown in FIG. 1 of this application.

Fluorescent fixture B includes a cover plate 30 having a generally circular outer edge 32. In the preferred arrangement, plate 30 is stamped from steel and includes a pair of diametrically opposed slots 34,36 which are utilized to mount the plate, along with the rest of fixture B, to outlet box A in a manner to be described hereinafter. Plate 30 also includes a central opening 38 and a pair of diameterically opposed threaded fastener receiving holes 40,42. The central opening provides an access opening for the electrical lead wires 44,46 passing between outlet box A and the operative components of fixture B. This distance between holes 40,42 is less than the distance between the innermost ends of slots 34,36. Moreover, holes 40,42 are offset from diametrical alignment with slots 34,36. In the preferred arrangement here under discussion, this offset is equal to 15° and is for reasons and purposes which will become apparent hereinafter.

Disposed adjacent cover plate 30 is an upper collar generally designated 50. This collar includes a base portion 52 having an upper engaging surface 54 and a lower engaging surface 55 with a small protrusion or upper spool shank 56 extending outwardly from surface 55. This shank, as well as base portion 52, includes a hole 58 extending therethrough to facilitate passage of leads 44,46. In addition, base portion 52 includes a pair of oppositely disposed threaded fastener clearance holes 60,62 therein which may be aligned with threaded receiving holes 40,42 for reasons which will be described in detail hereinafter. Any number of suitable insulative type materials may be employed in constructing collar 50 and in the preferred embodiment of the invention, phenolic material is employed.

A fluorescent tube fixture body cover is generally designated 80 and comprises an elongated generally U-shaped member constructed from thin metal or other suitable material. This cover includes a top or main wall 82 having side walls 84,86 depending therefrom along the opposed longitudinal edges thereof. Centrally disposed within top or main wall 82 is a circular spool receiving hole 88 adpated to facilitate close sliding receipt of the cover over spool 56 and to permit the passing of electrical lead wires 44,46 therethrough. Disposed slightly outwardly of spool receiving hole 88 are a pair of arcuate slots 90,92 which are employed to positively mount the fixture body cover to the fixture and to facilitate rotational movement thereof relative to the remainder of the fixture B.

In this regard, slots 90,92 are aligned with threaded fastener clearance holes 60,62 in base portion 52 of upper collar 50 and threaded fastener receiving holes 40,42 in cover plate 30. Arcuate slots 90,92 are oppositely disposed from each other and each extends over an arc of approximately 170°. Although this arc may be varied if desired without departing from the intent and scope of the present invention, it does provide adjustment of the fixture body cover for alignment purposed over an arc of 170° as will be apparent in subsequent description.

Disposed on the other side of top or main wall 82 from upper collar 50 is a force or biasing means generally designated 100. In the preferred embodiment of the present invention, this means comprises a generally flat washer-like member constructed from a resilient, compressible material. Although neoprene has proved acceptacle for constructing biasing means 100, it will be appreciated that other such materials or arrangements could be employed without departing from the intent and scope of the present invention. The washer-like member includes a pair of opposed generally flat faces 102,104 and further includes a generally centrally located opening 106 adapted to permit passing of electrical leads 44,46 therethrough. Face 102 is adapted to be placed in physical engagement with top or main wall 82 and face 104 is adapted to be placed in physical engagement with a lower collar which will be described hereinafter. This washer-like or annular member also includes a pair of oppositely disposed threaded fastener clearance holes 108,110 which are aligned with holes 40,42 and 60,62 and arcuate slots 90,92.

Finally, fluorescent fixture assembly B includes a lower collar member generally designated 120. This collar includes an upper engaging surface 122 adapted to engage face 104 of the washer-like member. Collar 120 has a circular configuration similar to that of upper collar 50 with a substantially similar diametric dimension. This lower collar also includes a central opening 124 extending therethrough and is constructed from phenolic material. Oppositely disposed from each other to extend through base collar 120 are a pair of threaded fastener clearance holes 126,128 which are in alignment with threaded fastener receiving holes 40,42, clearance holes 60,62, arcuate slots 90,92 and clearance holes 108,110. A pair of threaded fasteners or set screws 130,132 are then received through holes 126,128,108,110, slots 90,92 and holes 60,62, to be respectively threadedly received in holes 40,42 to facilitate assembly of the fixture.

Also preferably made a part of the overall structure of fixture B is a cover shield generally designated 140 in FIG. 1 and which is interposed between cover plate 30 and upper collar 50. This shield does not comprise a part of the operational aspects of the subject invention but rather, aids in providing an overall aesthetically pleasing appearance for the fixture once it has been installed. This shield may be conveniently molded from a plastic material such as, for example, styrene to have a generally flat bottom wall 142 and an upturned rim 144 terminating in an outer peripheral edge 146. The diameter of bottom wall 142 is at least slightly larger than the diameter of cover plate 30 in order that the cover plate may be received in the cover shield flat against the inside of shield bottom wall 142. It should also be noted that the diameter of the cover shield at peripheral edge 146 is greater than the maximum cross-sectional dimension of outlet box A.

Cover shield 140 also includes a central opening 148 to facilitate passage of electrical lead wires 44,46 and a pair of opposed threaded fastener clearance holes 150,152 dimensioned to received fasteners 130,132. Offset from holes 150,152 are two pairs of knock out holes 154,156 and 158,160 which will be aligned with slots 34,36 in cover plate 30 when fixture B is assembled. These knock out holes may be integrally formed in the cover shield in a manner such that they may be easily pieced by a hand tool and are employed in a manner which will hereinafter be described in greater detail. However, it should be noted that the spacing of pairs 154,156 and 158,160 is such to accommodate mounting fixture B to conventional outlet boxes having the same distance between threaded fastener receiving holes 18,20 in tabs or ears 14,16.

Attention is now particularly directed to FIGS. 2, 3 and 4 which show the exploded fluorescent fixture assembly B of FIG. 1 in the assembled condition. It should be appreciated that the lowermost ends of electrical leads 44,46 are adapted to be connected to the fluorescent tube and the other necessary ancillary operative components as, for example, ballast, starters, wiring, lamp holders, connectors and so on. The tube, as well as these other components, are all included within the fixture body cover 80 in any conventional or convenient manner. Inasmuch as these components are known and do not in and of themselves comprise a portion of the present invention, they are not shown or described further herein. It should be noted, however, that in order to circumvent lateral displacement and undesirable cantilever forces upon the fixture mounting to outlet box A, all operative components contained within and upon fixture body cover 80 should be mounted and affixed in positions which, in cumulative total, provide uniform and even weight distribution as transmitted to the axial fulcrum of the mounting.

As will be seen in FIGS. 3 and 4 and with the fixture in the assembled condition, the lower face of cover plate 30 engages the inner face of bottom wall 142 of cover shield 140, the outer face of bottom wall 142 engages upper engaging surface 54 of upper collar 50; lower engaging surface 55 of upper collar 50 engages the upper surface of top or main wall 82, face 102 of force means 100 engages the lower surface of top or main wall 82; and, lower surface 104 of force means 100 engages upper engaging surface 122 of lower collar 120. Although upper and lower collars 50,120 as well as force means 100 are shown as being circular and as having substantially the same outside diameters, other configurations and dimensions could be employed if desired. The preferred arrangement, however, provides satisfactory results insofar as the intent and scope of the present invention are concerned. In FIG. 4, threaded fasteners or set screws 130,132 are threadedly received in threaded receiving holes 40,42 of cover plate 30 and operate to retain cover shield 140, upper collar 50, fixture body cover 80, force means 100 and lower collar 120 in position relative to each other. In this regard, spool 56 also passes through spool receiving hole 88 in cover 80.

As will be seen in FIG. 2, threaded fasteners or set screws 130,132 pass through arcuate slots 90,92 in top of main wall of the fixture body cover to facilitate rotation of the cover relative to the remainder of the fixture. The directions of rotation are shown in FIG. 2 as *a* and *b* and extend about the entire arc defined by the two slots. Inasmuch as the slots oppositely disposed from each other extend through arc of 170°, the overall arc through which the fixture body cover may be rotated about an axis generally normal to the plane of the cover is 170°, i.e., from the point where the threaded fasteners 130,132 engage one end and the other of their associated slots. As shown in FIG. 2, the fasteners are disposed in generally the mid portion of their respective slots for purposes of illustration.

For mounting fixture B to outlet box A, two additional threaded fasteners 170,172 are conveniently employed. The fixture is located relative to the outlet box such that slots 34,36 are aligned with holes 18,20 in tabs 14,16. In a conventional outlet box and due to a predetermined location in cover shield 140, one of knock out hole pairs 154,156 and 158,160 will also be aligned with holes 18,20.

Thereafter and as shown in FIG. 3, the knock out portions of the appropriate pair may be removed and the fixture mounted to the outlet box by fasteners 170,172 passing through this pair of openings, through cover plate slots 34,36 and into threaded engagement with holes 18,20. The upper ends of electrical lead wires 44,46 are conventionally connected with electrical leads (not shown) in the outlet box itself in order that the necessary electrical energy may be supplied to the fixture components. As these threaded fasteners are threadedly advanced into holes 18,20, the entire fixture B will be drawn toward the plane of the wall or ceiling with which the outlet box is associated. In the final installed position, outer peripheral edge 146 of the cover shield will be closely spaced to the wall or ceiling and surround the outlet box opening therein so as to present an acceptable overall aesthetic appearance for the fixture mounting. It will be particularly noted from FIG. 2 that knock out opening pairs 154,156 and 158,160 and slots 34,36 are spaced outwardly of the lateral side walls 84,86 of fixture body cover 80. This arrangement facilitates fixture mounting without having to disturb the fixture components located in the housing.

A particularly important aspect of the present invention is the provision of means whereby rotation of fixture body cover 80 is readily permitted to facilitate alignment of the fluorescent tube following installation of the fixture to outlet box A and which also includes means to retain the cover in an aligned position when the fixture itself is subjected to vibrations, slight nudges and the like as would normally be encountered in most environments. Inasmuch as the operational components required to make the fluorescent tube operative, that is, self-contained ballast, starters, wires, lamp holders, connectors and so on are disposed within the U-shaped areas defined by the body cover, it would be very difficult and virtually impossible to gain access to threaded members 130,132 in order to loosen and/or tighten them each time an adjustment was desired. Such an arrangement would necessitate removal of at least some of the operative component parts and thus increase labor costs connected with using the type of self-contained fluorescent fixture to which the subject invention is directed.

Therefore, force means 100, which again in the preferred embodiment comprises a resilient, compressible washer-like or annular member plays an important role in overcoming these adjustment problems. When the fixture is initially assembled, threaded members or set screws 130,132 are tightened sufficiently to compress member 100 to an extent whereby it will place a continuous upwardly biasing force against top or main wall 82 of the fixture body cover to urge it into positive, forced contact with lower engaging surface 55 of upper collar 50. Thus, a frictional type force is created between the upper collar and the upper surface of top or main wall 82 which resists rotation of the body cover through arcuate slots 90,92 relative to the remainder of fixture B. This resistance may, of course, be overcome by a workman or the like applying a rotative force against the cover but this frictional force has been found sufficient to eliminate undesired rotational movement of the fixture caused by normal vibrations, nudges and the like. Naturally, the greater the degree of compression of the compressible washer, the greater the amount of frictional force generated between washer surface 102 and the inside portion of top or main wall 82. This adjustment is simply made by tightening or loosening threaded members 130,132 prior to installation of the operative components into the cover and prior to installation of fixture B to the conventional outlet box A.

Likewise, if a greater resistance to rotational movement was desired for some particular installation, the diameter of engaging surface 122 and faces 102,104 could be increased to provide a greater surface area over which the force means would operate. Also, it is possible to include a second force means which is substantially identical to force means 100 between engaging surface 55 of upper collar 50 and the upper surface of top or main wall 82. Such provisions may be deemed advisable and necessary for installations of the invention in locations which may be especially vulnerable to inadvertent physical contact, nudges or excessive vibrations. Further and while force means 100 is shown and described as being associated with the lower collar and lower surface of the fixture body cover, it is entirely possible to locate the force means on the other side of the cover in association with surface 55 of the upper collar.

Along the same lines, when using the preferred neoprene structure for force means 100, a definite advantage, insofar as intended results are concerned, is obtained. That is, neoprene force means 100 and metallic fixture body cover 80 have different coefficients of thermal expansion whereby the active electrical component contained within the fixture body become heated during electrical operation to thereby cause an increased frictional resistance at the juncture interface between the neoprene washer and the thin metallic fixture body cover. Typically, the structures will be assembled and installed in an ambient temperature of approximately 77° F, and after 4 hours of electrified operation, the interior of the fixture body cover can be expected to reach a temperature value of approximately 197° F. The 120° F. difference in temperatures will cause the neoprene washer to expand at a greater rate than the metallic fixture body cover to increase the compressive forces between the two dissimilar materials and members. The modulus of elasticity is a measurable value and the net end results, as specifically applicable to an installed and electrical functioning lamp fixture which incorporates the concepts of the subject invention, is that the compressive forces are increased. This causes a corresponding increase in the frictional drag resistance to rotational movement of the fixture.

As noted hereinabove, a 15° diametric offset is preferably included between slots 34,36 and threaded fastener receiving holes 40,42 in cover plate 30. This feature merely facilitates that the desired alignment for fixture B may be obtained when outlet box A is mounted in a wall or ceiling such that a line extending between tabs 14,16 extends precisely in the direction of desired location for the longitudinal axis of the fixture body cover. If receiving holes 40,42 were disposed in alignment with slots 34,36, such fixture alignment would be made impossible as threaded fasteners 130,132 would engage one end or the other of their respective slots 90,92 in cover 80 prior to reaching the desired aligned position. Accordingly, the 15° offset between the holes and slots overcomes this potential fixture alignment problem.

An alternative construction for the cover shield is shown in FIGS. 5 and 6. For ease of illustration and appreciation of the invention, like components are identified by like numerals with the addition of a primed (') suffix and new components are identified by new numerals. In FIG. 5, cover shield 140' has a substantially larger diameter than cover shield 140 hereinabove described in order to disguise a larger portion of a wall or ceiling. Typically, fixture body cover 80 will include a number of threaded fastener heads, nuts or the like (not shown) variously disposed along the outside surface of top or main wall 82 for accommodating the various operative components and retaining them in a mounted position to the inside portion of the top or main wall. Because of these small outward protrusions, it is necessary to provide a clearance area in order that the outside of cover shield bottom wall 142' will not interfere with them. For this reason and in the arrangement of FIGS. 5 and 6, bottom wall 142' includes an outwardly extending area 190 interconnected with the bottom wall by a flange area 192. Area 190 has a diameter slightly larger than the distance between clearance holes 150',152'. When using this alternative arrangement, outwardly protruding area 190 closely engages upper engaging surface 54 of upper collar 50 when the fixture itself is assembled. While the extent to which area 190 protrudes outwardly from bottom wall 142' may be varied as necessary and/or desirable, it has been found that approximately ⅛ inch is normally adequate to provide the sufficient additional clearance area. The use and operation of the cover shield shown in FIGS. 5 and 6 is the same as that described hereinabove with reference to FIG. 1 and, again, the benefit derived from this modified arrangement is that it will cover or disguise a larger wall or ceiling area.

Moreover, and while the two cover shield arrangements shown and described with reference to FIGS. 1-4 and FIGS. 5 and 6 both have generally circular configurations, it is also possible to provide other configurations as may be deemed necessary and/or desirable. For example, a square or other polygonal configuration could also be advantageously employed. In the event that a square configuration is chosen, however, it is normally deemed desirable to also provide means to permit adjustment of the cover shield relative to the remainder of the fixture structure. To accommodate this, central opening or clearance hole 148' may be conveniently enlarged such that it extends outwardly beyond the clearance openings designated 150,152 and 150',152' in the FIGURES to, in effect, eliminate these openings. In this manner, the cover shield will simply be frictionally gripped between the cover plate and the upper collar thereby allowing it to be independently rotated so that the corners of a square or other polygonal cover shield configuration may be aligned as desired.

In some instances, the outlet box may be recessed within a wall or ceiling structure. In this type of recessed outlet box mounting, the conventional mounting arrangement hereinabove described in detail may be extremely difficult or impossible to use. Therefore, to accommodate fixture mounting to a recessed outlet box, the arrangement shown in FIGS. 7 and 8 may be advantageously employed. For convenience, this structural arrangement is described with reference to the cover shield arrangement hereinabove described with reference to FIGS. 5 and 6.

In FIG. 7, an elongated mounting adaptor strip generally designated 200 is shown as having opposed parallel lateral side edges 202,204. A clearance hole 206 is centrally located in the strip and adapted to receive electrical wires passing between the outlet box and fluorescent fixture. Spaced longitudinally along the strip from opposite sides of center opening 206 are a pair of arcuate slots 208,210 which extend inwardly from side edges 202,204, respectively. The spacing of these slots is identical to the spacing between threaded fasteners 130',132' which pass through cover plate for mounting the rest of the fluorescent fixture thereto. These arcuate slots simply provide clearance areas for the outermost ends of these threaded fasteners as will become more readily appreciated hereinafter. It should be noted that each of these slots extends inwardly from its associated side edge 202,204 to a point 15° beyond the center line of the strip. This is simply to accommodate total adjustment of the fixture as was hereinabove described in detail.

Spaced outwardly beyond slots 208,210 are a pair of threaded fastener receiving holes 212,214. These holes are spaced apart similar to the spacing between the tabs or ears in a conventional outlet box and are alignable with slots 34',36' in the cover plate and one of clearance hole pairs 154',156' and 158',160° in the cover shield. Spaced outwardly of opening 212,214 are a plurality of clearance openings 216. These openings are used to mount strip 200 in a recessed outlet box area as is shown in FIG. 8. While strip 200 could be made from any number of materials, it is contemplated that it will be constructed from a bendable but yet relatively rigid metal in order that it may be bent along the line thereof for mounting to a particular recessed opening area in a wall or ceiling.

With particular reference to FIG. 8, outlet box A is shown as being mounted in a recessed area 220 which is recessed inwardly from the outermost plane or surface 222 of a wall or ceiling. With this arrangement, the fluorescent fixture cannot readily be mounted to the outlet box in the manner hereinabove previously described with reference to FIGS. 1-4 thus requiring the advantageous use of mounting strip 200. First, the ends of the strip are bent to form a generally U-shaped configuration with the legs of the U closely spaced to opposed side wall areas of recess 220. Once such bending has taken place, convenient and conventional fasteners 230,232 received through one of openings 216 in each of the side legs are used to affix strip 200 to the building structure in a manner such that the bottom portion of the U-shaped configuration is disposed generally coplanar with surface 222 of the wall or ceiling. Openings 212,214 receive elongated threaded fasteners 250,252 which are fully threaded therethrough as shown in FIG. 8. As noted above, openings 212,214 are spaced similar to the spacing for the outlet box tabs so that as the fluorescent fixture is placed adjacent a wall or ceiling, threaded members 250,252 will pass through slots 34',36' and clearance hole pair 158',160'. Also in FIG. 8, only the cover plate and cover shield are shown, it being understood that the remainder of the fluorescent fixture is affixed thereto in the manner discussed hereinabove in detail and shown in FIGS. 1-4.

Once threaded members 250,252 have been passed through the associated openings in the cover plate and cover shield, a pair of acorn nuts 254,256 are fully threadedly advanced thereon. When these acorn type nuts are fully advanced or bottomed out on the associated of the threaded member 250,252, further advancement of the nut will simply act to rotate the threaded members themselves. This results in the threaded members being withdrawn or backed out from their associated threaded openings 212,214. In this manner, the entire fluorescent fixture may be drawn toward plane 222 of a wall or ceiling until peripheral edge 146' of the cover shield engages that outer surface as hereinabove previously described. As the fixture is drawn toward the mounting strip, the outermost ends of threaded members 130',132' may pass through an associated one of slots 208,210 in the mounting strip. This then eliminates any intereference relationships between the various structural components preventing fixture alignment as may be desired. During mounting, electrical lead wires 260,270 are simply passed outwardly of the fluorescent fixture, through central opening 206 and toward the outlet box for interconnection with the electrical lead wires housed therein.

In using the subject invention which has been described in detail hereinabove, prior problems encountered with self-contained fluorescent light fixtures adapted for mounting to conventional outlet boxes have been successfully overcome. Although fixtures of this general type have been known, there have been many problems encountered with them with respect, first, to adjusting the fluorescent tubes to secure proper alignment and, second, to retaining that alignment in a reasonably permanent manner without requiring difficult and time consuming adjustment steps which often involved disassembly of much of the fluorescent fixture itself.

The invention has been described with reference to the preferred embodiment. Obviously, modifications and alterations will occur to others upon the reading and understanding of the specification. For example and insofar as the fixture itself is concerned, it is possible to utilize a pair of fluorescent tubes with one of the tubes connected to the conventional source of electrical energy and the other tube connected to an alternate or emergency source of electrical energy. In this manner, illumination from the fixture may be obtained during an outage of the main electrical energy source. By way of further example, the upper and lower collars, the cover plate and cover shield may be modified as deemed necessary and/or desirable to suit some specific operational or use criteria. It is my intention to include all such modifications and alterations insofar as they come within the scope of the appended claims or the equivalents thereof.

I claim:

1. A self-contained fluorescent lamp fixture comprising in combination:

a cover plate for mounting said fixture to an electrical outlet box;

a fixture body cover in operative association with said cover plate and which is adapted to receive and support a fluorescent light tube and its operative components, said fixture body cover including means for locating said body cover relative to said cover plate while permitting said body cover to be selectively rotated relative thereto about an axis disposed generally normal to the plane of said fixture body cover;

force means for continuously exerting a biasing force against said fixture body cover to urge said fixture body cover toward engagement with said cover plate to retain said fixture body cover in a desired position relative thereto, said force means allowing forced rotational movement of said fixture body cover relative to said cover plate for alignment purposes; and a cover plate shield interposed between said cover plate and fixture body cover for disguising the interconnection between said cover plate and outlet box.

2. The lamp fixture as defined in claim 1 including upper and lower collars respectively positioned above and below said fixture body cover, said force means being interposed between said fixture body cover and one of said collars, and assembly fasteners passing through said collars, force means and fixture body cover and being fastened to said cover plate for securing together said collars, force means and fixture body cover and for fastening same to said cover plate.

3. The lamp fixture as defined in claim 1 wherein said fixture body cover includes opposite sides and said cover plate extends outwardly beyond said opposite sides and has mounting fastener receiving apertures therethrough located outwardly of said opposite sides for receiving mounting fasteners for mounting said cover plate to an electrical outlet box.

4. A self-contained fluorescent lamp fixture comprising:

a fixture body cover adapted to receive a fluorescent tube and its operative components, said fixture body cover including a top wall having opposite longitudinal edges;

mounting means attached to said top wall for mounting said fixture body cover directly to an electrical outlet box or the like, said mounting means including a cover plate positioned closely adjacent said top wall and extending outwardly beyond said opposite longitudinal edges thereof to provide access externally of said fixture body cover beyond said longitudinal edges for mounting said lamp fixture directly to an electrical outlet box or the like; and said mounting means providing rotational movement of said fixture body cover relative to said cover plate about an axis extending generally perpendicular to said top wall and including force means for continuously exerting a biasing force generally perpendicular to said top wall to retain said fixture body cover in a desired rotated position relative to said cover plate while allowing forced rotational movement of said fixture body cover relative to said cover plate.

5. The lamp fixture as defined in claim 4 including assembly fasteners passing through said top wall of said fixture body cover and attaching thereto said mounting means including said cover plate and force means.

6. The lamp fixture as defined in claim 4 wherein said cover plate has a central opening therethrough aligned with a hole through said top wall located substantially centrally between said longitudinal edges, said central opening and hole having wires passing therethrough from said lamp fixture for connection to wires in the outlet box or the like to which said lamp fixture is mountable.

7. The lamp fixture as defined in claim 4 wherein said cover plate includes apertures therethrough outwardly of said longitudinal edges of said top wall of said fixture body cover for receiving mounting fasteners for mounting said lamp fixture directly to an electrical outlet box or the like.

8. The lamp fixture as defined in claim 4 wherein said cover plate has a pair of assembly fastener receiving holes for receiving a pair of assembly fasteners passing through said top wall, said cover plate having a pair of opposite apertures therein located outwardly of said longitudinal edges of said top wall, and said pair of apertures being angularly displaced approximately 15° from said pair of assembly fastener receiving holes.

9. The lamp fixture as defined in claim 4 wherein said mounting means includes collars positioned on opposite sides of said top wall and said force means is interposed between said top wall and one of said collars, and assembly fasteners passing through said collars, force means and top wall and being fastened to said cover plate for securing together said collars, force means, top wall and cover plate.

10. The lamp fixture as defined in claim 9 including an enlarged central opening in said cover plate aligned with a hole through said top wall for receiving wires from said lamp fixture.

11. The lamp fixture as defined in claim 10 including opposed slots in said cover plate extending inwardly from the outer periphery thereof for receiving mounting fasteners for mounting said cover plate directly to an electrical outlet box or the like, and said slots being located outwardly of said longitudinal edges of said top wall on said fixture body cover.

12. The lamp fixture as defined in claim 11 wherein said assembly fasteners are threaded and said cover plate has threaded holes therein threadably receiving said assembly fasteners.

13. A self-contained fluorescent lamp fixture comprising:

a fixture body cover adapted to receive a fluorescent tube and its operative components, said fixture body cover including a top wall having opposite longitudinal edges;

mounting means attached to said top wall for mounting said fixture body cover directly to an electrical outlet box or the like, said mounting means including a cover plate positioned closely adjacent said top wall and extending outwardly beyond said longitudinal edges;

said mounting means providing rotational movement of said fixture body cover relative to said cover plate about an axis extending generally perpendicular to said top wall and including force means for continuously exerting a biasing force generally perpendicular to said top wall to retain said fixture body cover in a desired rotated position relative to said cover plate while allowing forced rotational movement of said fixture body cover relative to said cover plate;

assembly fasteners passing through said top wall for securing said mounting thereto, said assembly fasteners being fastened to said cover plate and operating to hold together said fixture body cover, force means and cover plate;

said cover plate having apertures therethrough outwardly of said longitudinal edges for receiving mounting fasteners to secure said cover plate directly to an electrical outlet box or the like and thereby mount said lamp fixture thereto.

14. The lamp fixture as defined in claim 13 wherein said cover plate has a central opening aligned with a central hole in said top wall for receiving wires from said fixture, said cover plate having a pair of opposite threaded assembly fastener receiving holes on opposite sides of said central opening, said assembly fasteners being threaded and being threadably received in said assembly fastener receiving holes; and said apertures for receiving mounting fasteners being angularly displaced from said fastener assembly receiving holes.

15. The lamp fixture as defined in claim 14 wherein said apertures are angularly displaced approximately 15° from said assembly fastener receiving holes.

16. The lamp fixture as defined in claim 14 wherein said mounting means includes collars positioned above and below said top wall of said fixture body cover, said force means being positioned between said top wall and one of said collars, and said assembly fasteners passing through said collars as well as through said force means and top wall.

* * * * *